US008986407B2

(12) United States Patent
Upadhyay et al.

(10) Patent No.: US 8,986,407 B2
(45) Date of Patent: Mar. 24, 2015

(54) HIGH POROSITY ABRASIVE ARTICLES AND METHODS OF MANUFACTURING SAME

(75) Inventors: Rachana Upadhyay, Shrewsbury, MA (US); Richard W. J. Hall, Southborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 902 days.

(21) Appl. No.: 12/372,549

(22) Filed: Feb. 17, 2009

(65) Prior Publication Data

US 2009/0264050 A1 Oct. 22, 2009

Related U.S. Application Data

(60) Provisional application No. 61/046,134, filed on Apr. 18, 2008.

(51) Int. Cl.

| | |
|---|---|
| ***C09K 3/14*** | (2006.01) |
| ***B24D 11/00*** | (2006.01) |
| ***B24D 3/26*** | (2006.01) |
| ***B24B 37/24*** | (2012.01) |
| ***B24D 18/00*** | (2006.01) |

(52) U.S. Cl.

CPC *B24D 11/00* (2013.01); *B24D 3/26* (2013.01); *B24B 37/245* (2013.01); *B24D 18/00* (2013.01)

USPC ..... 51/298; 451/28; 451/57

(58) Field of Classification Search

USPC ..... 51/298

See application file for complete search history.

(56) References Cited

U.S. PATENT DOCUMENTS

| | | | | | |
|---|---|---|---|---|---|
| 3,098,730 | A | * | 7/1963 | Rowse | 51/298 |
| 3,418,273 | A | * | 12/1968 | Economy et al. | 524/396 |
| 3,573,158 | A | * | 3/1971 | Pall et al. | 162/131 |
| 4,025,490 | A | * | 5/1977 | Weaver | 525/504 |
| 4,239,503 | A | * | 12/1980 | Harris et al. | 51/298 |
| 4,522,953 | A | | 6/1985 | Barby et al. | |
| 4,642,126 | A | | 2/1987 | Zador et al. | |

(Continued)

FOREIGN PATENT DOCUMENTS

| | | |
|---|---|---|
| EP | 0060138 A1 | 9/1982 |
| EP | 0068830 B1 | 1/1986 |

(Continued)

OTHER PUBLICATIONS

Kristina Haibach et al. "Tailoring Mechanical Properties of Highly Porous Polymer Foams: Silica Particle Reinforced Polymer Foams Via Emulsion Templating", Polymer and Composite Engineering Group, Department of Chemical Engineering, Imperial College London, South Kensington Campus, London SW7 2AZ, UK, Polymer 47 (2006) pp. 4513-4519.

(Continued)

*Primary Examiner* — Kaj K Olsen
*Assistant Examiner* — Ross J Christie
(74) *Attorney, Agent, or Firm* — Joseph P. Sullivan; Abel Law Group, LLP

(57) ABSTRACT

An abrasive article includes a polymer matrix and abrasive grains dispersed in the polymer matrix, wherein the abrasive article has a void volume of at least 50%. The polymer matrix is polymerized from a monomer including at least one double bond.

8 Claims, 3 Drawing Sheets

(56) References Cited

U.S. PATENT DOCUMENTS

| | | | | |
|---|---|---|---|---|
| 4,750,915 | A * | 6/1988 | Tomita et al. | 51/298 |
| 5,006,339 | A | 4/1991 | Bargery et al. | |
| 5,114,438 | A * | 5/1992 | Leatherman et al. | 51/296 |
| 5,534,345 | A * | 7/1996 | Bradshaw | 428/323 |
| 5,583,162 | A | 12/1996 | Li et al. | |
| 5,594,064 | A * | 1/1997 | Bradshaw | 524/507 |
| 5,622,535 | A * | 4/1997 | Bradshaw | 51/298 |
| 5,651,943 | A | 7/1997 | Lam et al. | |
| 5,653,922 | A | 8/1997 | Li et al. | |
| 5,760,097 | A | 6/1998 | Li et al. | |
| 5,863,957 | A | 1/1999 | Li et al. | |
| 6,048,908 | A | 4/2000 | Kitagawa | |
| 6,100,306 | A | 8/2000 | Li et al. | |
| 6,218,440 | B1 | 4/2001 | Kitagawa | |
| 6,353,037 | B1 | 3/2002 | Thunhorst et al. | |
| 6,586,502 | B2 | 7/2003 | Wallace et al. | |
| 6,750,261 | B1 | 6/2004 | Clear et al. | |
| 6,759,080 | B2 | 7/2004 | Thunhorst et al. | |
| 6,890,963 | B2 | 5/2005 | Clear et al. | |
| 7,015,268 | B2 * | 3/2006 | Manwiller et al. | 524/444 |
| 7,066,801 | B2 * | 6/2006 | Balijepalli et al. | 451/526 |
| 7,084,197 | B2 | 8/2006 | Chin et al. | |
| 7,152,609 | B2 | 12/2006 | Li et al. | |
| 7,243,658 | B2 | 7/2007 | Deevi et al. | |
| 7,271,265 | B2 | 9/2007 | Haugland et al. | |
| 2003/0045213 | A1 * | 3/2003 | Keipert et al. | 451/57 |
| 2004/0033771 | A1 * | 2/2004 | Hirokawa et al. | 451/526 |
| 2004/0102574 | A1 | 5/2004 | Barber et al. | |
| 2004/0166779 | A1 * | 8/2004 | Balijepalli et al. | 451/41 |
| 2004/0166790 | A1 * | 8/2004 | Balijepalli et al. | 451/526 |
| 2004/0215010 | A1 | 10/2004 | Kumarev | |
| 2004/0236027 | A1 | 11/2004 | Maeji et al. | |
| 2005/0045564 | A1 | 3/2005 | Akay et al. | |
| 2005/0074796 | A1 | 4/2005 | Yue et al. | |
| 2005/0096315 | A1 | 5/2005 | Batchelor et al. | |
| 2005/0101227 | A1 * | 5/2005 | Balijepalli et al. | 451/41 |
| 2005/0250214 | A1 | 11/2005 | Gee | |
| 2005/0250957 | A1 | 11/2005 | Haugland et al. | |
| 2005/0261417 | A1 | 11/2005 | Mezzenga et al. | |
| 2006/0075686 | A1 * | 4/2006 | Hasegawa et al. | 51/293 |
| 2006/0116054 | A1 * | 6/2006 | Hasegawa et al. | 451/41 |
| 2006/0127369 | A1 | 6/2006 | Christensen et al. | |
| 2007/0043147 | A1 * | 2/2007 | Higgins et al. | 523/160 |
| 2007/0134685 | A1 | 6/2007 | Mauro et al. | |
| 2007/0213422 | A1 | 9/2007 | Collier et al. | |

FOREIGN PATENT DOCUMENTS

| | | | |
|---|---|---|---|
| EP | 0060138 | B1 | 9/1986 |
| EP | 0351907 | A2 | 7/1989 |
| EP | 0721774 | A2 | 7/1996 |
| EP | 0721774 | B1 | 10/2002 |
| EP | 1034183 | B1 | 9/2004 |
| JP | 62-157770 | A | 7/1987 |
| JP | 2004-034173 | | 2/2004 |
| JP | 2005-342874 | | 12/2005 |
| WO | 99/24458 | A1 | 5/1999 |
| WO | 02/43921 | A1 | 6/2002 |
| WO | 2006/083688 | A1 | 8/2006 |

OTHER PUBLICATIONS

Angelika Menner et al. New Evidence for the Mechanism of the Pore Formation in Polymerising High Internal Phase Emulsions or Why polyHIPEs Have an Interconnected Pore Network Structure Polymer and Composite Engineering Group, Department of Chemical Engineering, Imperial College London, South Kensington Campus, London SW7 2AZ, UK, Macromol. Symp. 2006, 242, pp. 19-24.

Angelika Menner et al "Particle-Stabilized Surfacant-Free Medium Internal Phase Emulsions as Templates for Porous Nanocomposite Materials: poly-Pickering-Foams" Polymer and Composite Engineering Group, Department of Chemical Engineering, Imperial College London, South Kensington Campus, London SW7 2AZ, UK, Langmuir 2007, 23, pp. 2398-2403.

Angelika Menner et al. "A New Route to Carbon Black Filled polyHIPEs", Polymer and Composite Engineering Group, Department of Chemical Engineering, Imperial College London, South Kensington Campus, London SW7 2AZ, UK, Soft Matter, 2006, 2, pp. 337-342.

Angelika Menner et al. "Open Porous Polymer Foams Via Inverse Emulsion Polymerization: Should the Definition of High Internal Phase (Ratio) Emulsions Be Extended?", Polymer and Composite Engineering Group, Department of Chemical Engineering, Imperial College London, South Kensington Campus, London SW7 2AZ, UK, Macromolecules 2006, 39, pp. 2034-2035.

Angelika Menner et al. "Tough Reinforced Open Porous Polymer Foams Via Concentrated Emulsion Templating", Polymer and Composite Engineering Group, Department of Chemical Engineering, Imperial College London, South Kensington Campus, London SW7 2AZ, UK, Polymer 47 (2006) pp. 7628-7635.

Saint-Gobain Abrasives, Inc. "Backgrinding", www.electronics.saint-gobain.com/Data/Element/Nods/Application_edit . . . , printed Mar. 19, 2008, pp. 1-6.

International Search Report for PCT/US2009/034305 mailed Oct. 5, 2009, 1 page.

* cited by examiner

HIGH POROSITY ABRASIVE ARTICLES AND METHODS OF MANUFACTURING SAME

CROSS-REFERENCE TO RELATED APPLICATION(S)

The present application claims priority from U.S. Provisional Patent Application No. 61/046,134, filed Apr. 18, 2008, entitled "HIGH POROSITY ABRASIVE ARTICLES AND METHODS OF MANUFACTURING SAME," naming inventors Rachana Upadhyay and Richard Hall, which application is incorporated by reference herein in its entirety.

FIELD OF THE DISCLOSURE

This disclosure, in general, relates to high porosity abrasive articles and methods for making such high porosity abrasive articles.

BACKGROUND

Abrasive articles are used in various industries to machine work pieces, such as by lapping, abrading, or polishing. Machining utilizing abrasive articles spans a wide industrial scope from the optics industry, the automotive body repair industry, to the semiconductor fabrication industry. In each of these examples, abrasives are used to remove bulk material or affect surface characteristics of products or work pieces.

In a particular example, the semiconductor industry uses abrasive articles to remove bulk material from the backside of a semiconductor wafer, known as backgrinding. Backgrinding often includes multiple machining steps, including a coarse grind to effect bulk material removal, followed by one or more fine grind steps to reduce subsurface damage, and provide a smooth surface finish that may be within a range of 50 to 500 Angstroms, for example. Such processing is believed to result in more consistent electrical properties in the substrate of the circuits printed on the front side of the semiconductor wafer. Moreover, with the advent of technologies that rely on the formation of electrical connections through the wafer, backside planarization, bulk material removal, and surface quality are becoming increasingly important.

However, the bulk material removal rate and the surface quality of the backside of the semiconductor wafer are notably dependent on not only the grit size of the abrasive article used in machining, but also on structure of the abrasive article. In particular, abrasive articles that trap dislodged abrasive grains and swarf between the abrasive article and the wafer often cause scratching in the surface of the wafer. As such, the surface quality on the backside of the wafer is poor following abrasion, which may influence the electrical properties and the circuitries formed on the front side of the wafer.

As such, an improved abrasive article would be desirable.

SUMMARY

In a particular embodiment, an abrasive article includes a polymer matrix and abrasive grains dispersed in the polymer matrix. The polymer matrix is polymerized from a monomer including at least one double bond. The abrasive article has a void volume of at least 50%, such as at least 65%. In a particular example, the abrasive grains have an average particle size of 0.1 μm to 100 μm, such as 0.1 μm to 10 μm. In another particular example, the abrasive grains are selected from the group consisting of silica, alumina, zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, and emery. For example, the abrasive grains may be superabrasive grains selected from the group consisting of cubic boron nitride, hard carbonaceous materials and a mixture thereof. In a further example, the abrasive grains have a Mohs hardness of at least 8. In a particular example, the abrasive article includes greater than 10 wt % of the abrasive grains. In another particular example, the abrasive article includes 2 vol % to 30 vol % of the abrasive grains. In an exemplary case, the polymer matrix includes a polymer formed of a monomer selected from the group consisting of vinyl, acrylate, methacrylate, conjugated diolefin, allene, and olefin halide monomers. In another example, the polymer matrix has an open cell structure, such as an open cell structure having a pore and throat configuration. Further, the abrasive article may have a surface area of at least 2.0 $m^2/g$, such as at least 3.0 $m^2/g$.

In another exemplary embodiment, a method of forming an abrasive article includes combining polymeric precursors and abrasive grains to form a first liquid component, forming an emulsion from the first liquid component and a second liquid component, and curing the polymeric precursors of the first liquid component. The second liquid component is substantially immiscible with the first liquid component. The polymer precursors include a monomer including at least one double bond. In an example, combining the polymer precursors and the abrasive grains includes combining an emulsifier with the polymer precursors and the abrasive grains. In an additional example, combining the polymer precursors and the abrasive grains includes combining a stabilizing agent. In a particular example, curing comprises exposing the emulsion to actinic radiation or thermal energy. In another particular example, forming the emulsion includes forming the emulsion with at least 65 vol % of the second liquid component. In an additional example, the method further includes treating the abrasive grains with a coupling agent. In a particular example, the coupling agent is hydrophobic. In a further particular example, the polymer precursors are thermally curable. In another particular example, the polymer precursors are polymerizable through free radical polymerization. In particular, the first liquid component may be hydrophobic. In an example, combining the polymer precursors and the abrasive grains includes combining at least 10 wt % of the abrasive grains. In a further example, the abrasive grains have an average particle size of 0.5 μm to 6 μm.

In an additional exemplary embodiment, a method of polishing an article includes applying an abrasive article to the surface of the article and abrading the surface of the article. The abrasive article includes a polymer matrix and abrasive grains dispersed in the polymer matrix. The polymer matrix is polymerized from a monomer including at least one double bond. The abrasive article has a void volume of at least 50 vol %, such as at least 65 vol %. In an example, the abrasive article includes greater than 10 wt % of the abrasive grains.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE DRAWINGS

Figure 1:
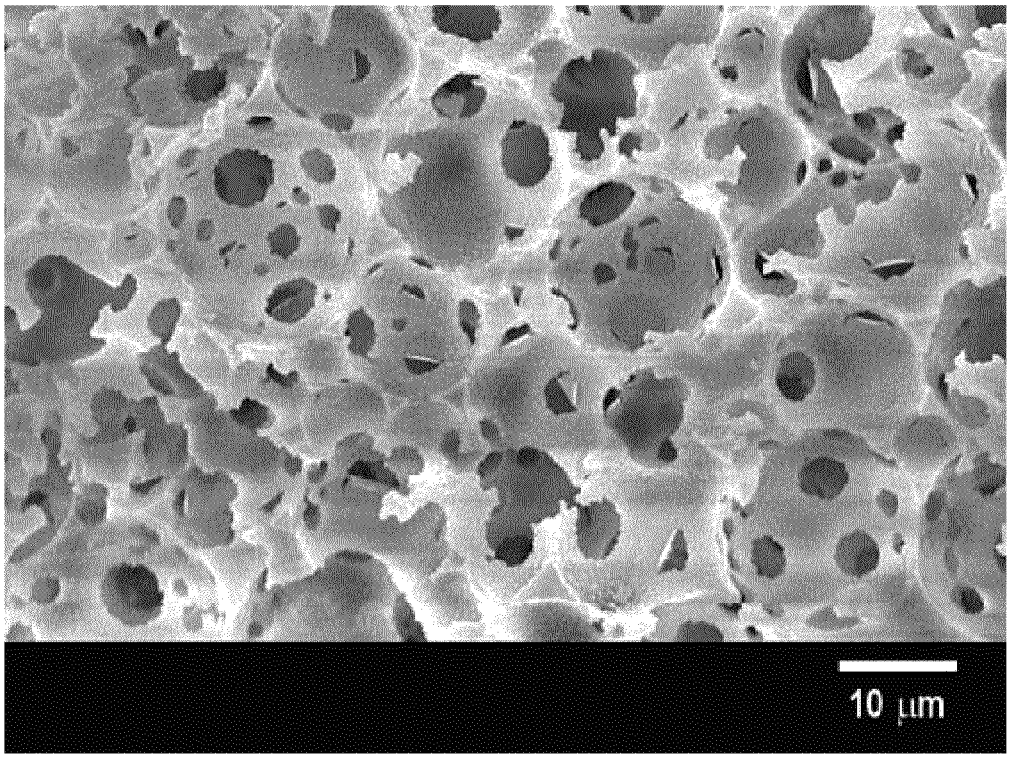
FIG. 1 includes an illustration of an open cell structure exhibiting a pore and throat configuration.

In a particular embodiment, an abrasive article includes a polymer matrix and abrasive grains dispersed within the polymer matrix. The abrasive article has a void volume of at least 50 vol %. In a particular example, the abrasive article has an open cell structure in which the void space exhibits a pore and throat configuration. In an example, the abrasive grains have an average particle size of at least 0.5 μm. In a further example, the abrasive grains may have a Moh's hardness of at least 8 and may include super abrasive grains.

In a further exemplary embodiment, the abrasive article may be formed using medium to high interface polymer emulsions. For example, an emulsion may be formed of a first liquid component and a second liquid component, the second liquid component being immiscible with the first liquid component. In this embodiment, the first liquid component forms a continuous phase surrounding the discontinuous second liquid component. In an example, the first liquid component includes polymeric precursors and abrasive grains. Once the emulsion is formed, a copolymer derived from the polymer precursors of the first liquid component is further polymerized, such as through radiation curing or thermal curing, to form a polymer matrix in which the abrasive grains are dispersed. In an example, the polymer precursors are curable through free radical mechanisms. Depending upon the amount of the first liquid component used relative to the second liquid component, the polymer matrix that results from polymerization of the polymer precursors forms an open cell foam exhibiting a pore and throat configuration.

In a further exemplary embodiment, the abrasive article is used to abrade a surface of a work piece. Here, the abrasive article is formed of a polymer matrix and abrasive grains are dispersed within the polymer matrix. The abrasive article has a void volume of at least 50 vol %. The abrasive article is contacted with the surface of a work piece, and at least one of the work piece and the abrasive article is moved relative to the other. In addition, cooling fluid may be applied to the surface of the abrasive article and may flow between the abrasive article and the work piece. The cooling fluid may be deployed to flow through the abrasive article or swarf may be drawn through the abrasive article.

In an exemplary embodiment, the first and second liquid components are immiscible in each other. In an example, the first liquid component is hydrophobic, while the second liquid component is hydrophilic or is formed of a water-based solution. Alternatively, the first liquid component may be a water-based solution including hydrophilic polymer components, while the second liquid component is an oil-based hydrophobic component. Alternatively, the first and second liquid components both may be oil-based component that form substantially immiscible phases. In the foregoing examples, the first liquid component forms a continuous phase of the emulsion and the first liquid component includes the polymer precursors that are polymerized to form the solid polymer matrix.

When forming the emulsion, the first liquid component can be present in an amount of 3% to 50% by volume, such as not greater than about 50% by volume. For example, the first liquid component can be present in an amount not greater than about 40 vol %, such as not greater than 35 vol %, not greater than about 30 vol %, or even not greater than 25 vol %. On the other hand, the second liquid component can be present in an amount of 50 vol % to 98 vol %, such as at least 50 vol %, at least 60 vol %, at least 65 vol %, at least 70 vol %, or even as high as 75 vol % or higher.

In an embodiment, the first liquid component contains polymer precursors and abrasive grains. In addition, the first liquid component may include additives, such as catalytic agents, crosslinking agents, emulsifiers, emulsion stabilizers, coupling agents, or a combination thereof.

The polymer precursor may be a monomer or may be a prepolymer. For example, the polymer precursor may include monomers that may polymerize to form a homopolymer or a copolymer. In another example, the polymer precursor includes polymer components, such as prepolymers, that include functional groups that may be further reacted to form a polymer matrix. In an example, such functional groups react with each other or react with chain extenders or crosslinking agents. In a particular example, the polymer precursors include a monomer including at least one double bond.

In an example, the polymer precursor polymerizes though a radical polymerization process. In another example, the polymer precursor polymerizes through a cationic polymerization process. Further, depending upon the polymeric system and catalytic system used to initiate the polymerization, the polymeric precursor may be polymerized using actinic radiation or thermal treatment.

In particular, the nature of the polymer precursor and other additives depends on whether the first liquid component is a hydrophobic or hydrophilic component. In the case in which the first liquid component forms a hydrophobic phase, the polymer precursors are generally hydrophobic and exhibit low solubility in aqueous phases.

An example of a polymer precursor useful in a hydrophobic first liquid component includes a monomer having a polymerisable vinyl group, such as monoalkenyl arene monomers, for example α-methylstyrene, chloromethylstyrene, vinylethylbenzene, or vinyl toluene; an acrylate or methacrylate ester, for example, 2-ethylhexyl acrylate, n-butyl acrylate, isobutyl acrylate, t-butyl acrylate, hexyl acrylate, n-butyl methacrylate, lauryl methacrylate, or isodecyl methacrylate; a conjugated diolefin such as butadiene, isoprene, or piperylene; allenes, for example, allene, methyl allene, or chloroallene; an olefin halide, for example vinyl chloride, vinyl fluoride, or polyfluoro-olefin; or a combination thereof. In a particular example, the polymer precursor is styrene. In any case, the polymer precursor has a low solubility in water, and more preferably is insoluble in water. Optionally, the first liquid component may include two or more polymer precursors, which monomers may, for example, be selected from the above list of monomers, and may form a copolymer following the polymerization reaction.

In addition to the polymer precursors, a hydrophobic first liquid component may include a crosslinking agent. An exemplary crosslinking agent includes a multifunctional unsaturated monomer capable of reacting with the polymer precursor. Such crosslinking agents may include at least two functional groups, such as vinyl groups, acrylate groups or methacrylate groups. The crosslinking agent may include, for example, difunctional unsaturated crosslinking monomers such as divinylbenzene, diethylene glycol dimethacrylate, 1-3-butanediol dimethacrylate, or allyl methacrylate; or tri-, tetra- or penta-functional unsaturated crosslinking monomers, such as trimethylolpropane trimethacrylate, pentaerythritol tetramethacrylate, trimethylolpropane triacrylate, pentaerythritol tetra-acrylate, glucose pentaacrylate, glucose diethylmercaptal pentaacrylate, or sorbitan triacrylate; poly-functional unsaturated crosslinking monomers such as polyacrylates (e.g., sucrose per(meth)acrylate or cellulose(meth)acrylate); or a combination thereof. In a particular example, the crosslinking agent includes divinyl benzene. In another example, the crosslinking agent includes 1,4-butanediol dimethacrylate. Further, the relative amount of crosslinking agent to the polymer precursor may be in the range of about 0.5 wt % to about 70 wt %, such as in a range of about 2 wt % to about 40 wt %, or even in a range of about 5 wt % to about 20 wt %, based on the amount of polymer precursor. In addition, a hydrophobic first liquid component may include an emulsifier.

In addition, the hydrophobic first liquid component may include an emulsion stabilizer. An exemplary stabilizer includes a surfactant soluble in an oil phase, such as the hydrophobic first liquid component. Suitability of such surfactants may be determined according to the hydrophilic-lipophilic balance (HLB value) of a surfactant. Typically, suitable surfactants have very limited solubility in the internal phase (e.g., the aqueous phase of a water-in-oil emulsion) to adequately stabilize a high internal phase emulsion and prevent phase inversion occurring spontaneously. In a particular example, the surfactant may have an HLB value in the range of from 2 to 6, such as about 4. The surfactant may be nonionic, cationic, anionic, or amphoteric. An example of a surfactant may include a sorbitan fatty acid ester, a polyglycerol fatty acid ester, or a polyoxyethylene fatty acid or ester, or a combination thereof. An example of a sorbitan fatty acid ester includes sorbitan monolaurate (available as SPAN® 20), sorbitan monooleate (SPAN® 80), combinations of sorbitan monoleate (SPAN® 80) with sorbitan trioleate (SPAN® 85), or a combination thereof. Another suitable surfactant includes "TRIODAN® 20", which is a polyglycerol ester available from Grindsted®, or "EMSORB® 252", which is a sorbitan sesquioleate available from Henkel®.

In an example, the surfactant is present in the emulsion in an amount in a range of about 1 wt % to about 50 wt %, such as in a range of about 5 wt % to about 40 wt %, in a range of about 15 wt % to about 40 wt %, in a range of about 20 wt % to about 35 wt %, or even in a range of about 25 wt % to about 33 wt % based on the amount of polymer precursor present.

In addition, the first liquid component may include a catalyst or initiator. Depending upon the reactive nature of the polymer precursor, the catalyst may be a free radical initiator or may be a cationic catalyst. In addition, the catalyst may be activated through radiation or may be activated through thermal treatment.

Initiation of the polymerization reaction may be accomplished by simply heating the emulsion comprising a polymerizable monomer composition or by irradiation with UV or other electromagnetic or actinic irradiation. In an example, the initiation of the polymerization reaction comprises heating the emulsion to form a polymerization initiator species, e.g., a free radical initiator, from an initiator precursor present in the emulsion. An example of an oil soluble initiator includes an azo compound such as azobisisobutyronitrile; a peroxide such as benzoyl peroxide, methyl ethyl ketone peroxide, alkylperoxycarbonate such as di-2-ethylhexyl peroxydicarbonate or di(sec-butyl)peroxydicarbonate, or alkyl peroxycarboxylate such as t-butyl peroxyisobutyrate, 2,5-dimethyl-2,5-bis(2,3-ethylhexanoylperoxy)hexane, or t-butyl peroctoate; or a combination thereof. An exemplary alkylperoxycarbonate is branched at the 1-position and an exemplary alkylperoxycarboxylate is branched at the α-position or the 1-position.

According to an embodiment, while the polymer precursors are in the hydrophobic first liquid component, the presence of an initiator precursor in both the hydrophobic (e.g., oil) phase and the aqueous phase or in the aqueous phase alone may be desirable to ensure more rapid completion of the polymerization reaction. As such, an example of an initiator precursor includes oil soluble initiator precursors and water soluble initiator precursors. An example of a water soluble initiator may include a persulfate such as potassium or sodium persulfate, a redox coupler initiator system such as ammonium persulfate together with sodium metabisulfite, or a combination thereof. In particular, the initiator precursor includes one or more of potassium persulfate, AIBN (azobisisobutyronitrile), or a redox couple initiator system comprising, for example, ammonium persulfate and sodium metabisulfite. The initiator precursor may form part of the oil phase (e.g. AIBN) or the aqueous phase (e.g. potassium persulfate or an aqueous redox coupling system) or both (e.g. AIBN in the oil phase and potassium persulfate in the aqueous phase).

On the other hand, the first liquid component may be hydrophilic or may be formed in an aqueous solution. An exemplary polymer precursor includes hydrophilic functional groups. For example, a polymer component for use in a hydrophilic or aqueous first liquid component includes vinyl monomers having unsaturated sulfonic acid groups, for example, acryl amido methyl propane sulfonic acid, allyl sulfonic acid, or a combination thereof. An exemplary vinyl monomer having an unsaturated amino group is dimethyl aminoethyl methacrylate. An exemplary vinyl monomer having unsaturated carboxyl groups includes, for example, acrylic acid, methacrylic acid, maleic acid, or fumaric acid, and examples of suitable vinyl monomers having unsaturated carboxylate groups include acrylate, methacrylate, hydroxyethylmethacrylate, diethylaminoethyl methacrylate, hydroxyethylacrylate, diethylaminoethylacrylate, malate, fumarate, methoxypolyethyleneglycol methacrylate, phenoxypolyethyleneglycol methacrylate, or a combination thereof.

The polymer precursor may also include a water-soluble salt of an unsaturated carboxylic acid. For example, a water-soluble salt may include alkaline metal salt, alkaline earth metal salt, or ammonium salt of acrylic acid, methacrylic acid, acrylic methacrylic acid, or a combination thereof. Another example of a suitable hydrophilic monomer includes vinyl pyridines, vinylpyrrolidones, acrylamide, methacrylamide, N-methylmethacrylamide, N-acryloylmorpholine, N-vinyl-N-methacetamide, derivatives thereof, or a combination thereof.

In a particular example, the first liquid component includes the polymer precursor in an amount in a range of about 0.5 wt % to about 30 wt % of the emulsion, such as a range of about 5 wt % to about 20 wt %. In an example, the polymer precursors include a monomer having at least one double bond and a hydrophilic functional group.

In addition, a hydrophilic first liquid component may include a crosslinking agent. In general, the crosslinking agent can be selected from a wide variety of polyfunctional monomers that are hydrophilic or at least partially soluble in the monomer component of the emulsion. For a crosslinker that is partially soluble in the monomer component, at least about 50% of the crosslinker dissolved in a 50:50 mixture of hydrophilic monomer and oil discontinuous phase partitions into the hydrophilic monomer phase when the mixture is allowed to separate into two phases.

An exemplary crosslinking agent includes a polyallyl compound, such as N,N'-diallyl acrylamide, diallylamine, diallyl methacrylamide, diallylamine diallylmethacrylamide, diallyl phthalate, diallyl malate, diallyl phosphate, diallyl terephthalate, N,N'-diallyltartardiamide, triallylcitrate, triallyl cyanurate, or triallyl phosphate; a polyvinyl compound, such as divinylbenzene, divinyl sulfone, ethylene glycol divinylether (e.g., diethylene glycol divinylether), N,N'-methylene-bis-acrylamide, piperazine diacrylamide, N,N'-dihydroxy-ethylene-bis-acrylamide, ethylene glycol acrylate (e.g., ethylene glycol di-, tri-, or tetra-acrylate), ethylene glycol methacrylate (e.g., ethylene glycol di-, tri-, or tetra-methacrylate), or glycerin trimethacrylate; a hydroxyvinyl compound, such as hydroxyethylacrylate, or 2-hydroxyethyl methacrylate; an inorganic salt or organic metal salt that generates polyhydric ions such as calcium, magnesium, zinc, or aluminum; or a combination thereof. N,N'-bis-acrylylcystamine and the like are also suitable for use in producing hydrophilic polymers. A single crosslinker type or a mixture of types can be employed in the emulsion. In particular, the crosslinker may be N,N'-methylene-bis-acrylamide, divinyl sulfone, diethylene glycol divinylether, ethylene glycol diacrylate, or a combination thereof.

In an example, the first liquid component includes the crosslinker in an amount in a range of about 0.005 wt % to about 30 wt % of the emulsion, such as a range of about 1 wt % to about 10 wt %.

Further, the hydrophilic first liquid component may include an emulsifier. An exemplary emulsifier includes a hydrophobic cyclic head group and a hydrophilic tail. An exemplary hydrophobic cyclic head group may include between about 3 and about 7 carbon atoms and is selected to provide sufficient rigidity at the hydrophobic end of the molecule to reduce the tendency of the emulsion to reverse (i.e., the tendency of the oil discontinuous phase to become the continuous phase). For example, the head group may be a cyclic group with multiple hydrophobic groups, such as, for example, alkyls, cyclic hydrocarbon groups, or aromatic groups, or a combination thereof. Preferably, the head group does not include hydrophilic groups, such as, for example, ionic groups including oxygen, nitrogen, and sulfur. In particular, the head group consists of carbon and hydrogen atoms.

An example of an emulsifier includes sugar fatty acid esters, such as distearate, alkylaryl polyether alcohol, or a combination thereof. In a further example, an alkylaryl polyether alcohol preparation suitable for use in producing the hydrophilic polymers has an average number of ethylene oxide units per ether side chain of about 14 or more. Exemplary emulsifiers are sold under the tradename Triton™ X.

In an example, the first liquid component includes an emulsifier in an amount in a range of about 1 wt % to about 30 wt % of the emulsion, such as a range of about 1 wt % to about 20 wt %, or even a range of about 1 wt % to about 5 wt %.

In addition, the first liquid component may include a stabilizer. The stabilizer can be a film-forming compound that is soluble in the hydrophilic monomer phase and sufficiently hydrophobic to stabilize the interface with the oil discontinuous phase of the emulsion. Suitable stabilizers act by forming a continuous film by entanglement of relatively strong polymer chains. Stabilizers useful in this regard include polymeric film formers for the interface between the hydrophilic monomer phase of the emulsion and the oil phase(s). An exemplary stabilizer may include a polymer of cellulose derivative, polyacrylate (e.g., polyacrylic acid or polymethacrylic acid), polyalkylene glycol (e.g., polyethylene glycol), partially hydrolyzed polyvinyl alcohol (e.g., PVA less than about 70-80% hydrolysis), another polyol, guar gum, agar gum, or a combination thereof. Also suitable for use as the stabilizer are copolymers of ethylenically unsaturated monomers, such as malein polybutadiene, malein polyethylene, malein poly α-olefin, or a combination thereof. For example, cellulose derivatives include methyl cellulose, hydroxymethyl cellulose, hydroxyethyl cellulose, ethylhydroxyethyl cellulose, hydroxypropyl cellulose, other cellulose ethers, cellulose esters, such as cellulose acetate, cellulose butylate, or cellulose acetate butylate, or a combination thereof. In particular, the stabilizer may be methyl cellulose, hydroxyethyl cellulose, PVA, or a combination thereof. In particular, the first liquid component may include a stabilizer in amounts in a range of about 0.001 wt % to about 2 wt % of the emulsion, such as a range of about 0.001 wt % to about 1 wt %, or even a range of about 0.001 wt % to about 0.7 wt % of the emulsion.

In addition to the polymer precursor, the first liquid component can include abrasive grains. Exemplary abrasive grains may include a metal or semi-metal oxide, nitride, or carbide. Alternatively, the abrasive grains may include an inorganic carbonaceous grain, such as diamond. An example of an abrasive grain includes silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, or a combination thereof. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, hard carbonaceous material, or a blend thereof Particular embodiments have been created by use of dense abrasive grains comprised principally of α-alumina. In a particular example, the abrasive grains have a Mohs hardness of at least 8, such as at least 8.5, or even at least 9. In an example, the abrasive grains are silicon carbide. In a further example, the abrasive grains may be selected from super abrasive grains, such as hard carbonaceous materials, cubic boron nitride, or any combination thereof. For example, hard carbonaceous materials include diamond, aggregated diamond nanorods, or any combination thereof. In a particular embodiment, the abrasive grains include diamond. The abrasive grains may also have a particular shape. An example of such a shape includes a rod, a triangle, a pyramid, a cone, a solid sphere, or a hollow sphere. Alternatively, the abrasive grain may be randomly shaped. In a particular example, the abrasive grain has sharp edges or breaks to form sharp edges.

In general, the abrasive grains have an average particle size in a range of about 0. 1 μm to about 100 μm. For example, the abrasive grains may have an average particle size in a range of about 0.1 μm to about 10 μm, such as about 0.1 μm to about 6 μm, about 0.5 μm to about 6 μm, or even about 1 μm to about 3 μm. Further, the abrasive grains may have an average particle size greater than 500 nm, such as at least about 1 μm. In addition, the abrasive grains may have an average particle size not greater than about 6 μm, such as not greater than about 3 μm.

The first liquid component may include the abrasive grains in an amount that results in an abrasive article that includes the abrasive grains in a range of about 2 vol % to about 30 vol % based on the total volume of the abrasive article. For example, the resulting abrasive article may include the abrasive grains in an amount of 4 vol % to 26 vol %, such as 10 vol % to 25 vol % based on the total volume of the abrasive article. In an example, the first liquid component includes the abrasive grains in a range of about 5 vol % to about 80 vol %, such as a range of about 10 vol % to about 75 vol %, or even a range of about 20 vol % to about 60 vol %. In a particular example, the first liquid component includes abrasive grains in an amount that forms at least about 10% by weight of the final abrasive article. For example, the final abrasive article may include greater than 10% by weight abrasive grains, such as at least about 15% by weight abrasive grains or even as high as about 20% by weight abrasive grains or higher.

In addition, the first liquid component may include a reinforcing filler. An exemplary reinforcing filler includes silica, zinc oxide, titania, alumina, zirconia, vanadia, chromia, iron oxide, antimony oxide, tin oxide, other colloidal metal oxides, or a combination thereof. The reinforcing filler may be included in an amount not greater than about 10 wt %, such as not greater than about 5 wt % based on the total weight of the abrasive article. In a particular example, the reinforcing filler has an average particle size in a range of 25 nm to 500 nm, such as not greater than about 0.5 μm, not greater than about 300 nm and in particular, in a range of about 30 nm to about 250 nm.

The abrasive grains or the optional reinforcing filler may be treated with a surface treatment or coupling agent to facilitate dispersion within the first liquid component. For example, a coupling agent or surface agent may be included in the first liquid component to facilitate dispersion of the abrasive grains within that liquid component. In addition, the coupling agent or surface agent may react with the polymer precursor to bind the abrasive grains within the polymer matrix formed from the first liquid component. The nature of the coupling agent depends upon the nature of the abrasive grain and the nature of the first liquid component and polymer precursors. When the polymer components include hydrophobic components, the coupling agent may include a hydrophobic end compatible with or reactive to the polymer precursors. Alternatively, when the polymer components are hydrophilic, the coupling agent may include the functional groups that are polar and hydrophilic. For example, the polymer precursor reactive groups may include acrylate, methacrylate, hydroxysilane, hydrosilane, epoxy, or vinyl groups, or a combination thereof. Further, the coupling agent may include functional groups configured to react with functional groups of the abrasive grains. Particular metal oxides tend to include hydroxide surface groups which may be reactive with functional groups, such as carboxylic acids, phosphonic acids, sulfonic acids, or a combination thereof. Alternatively, the abrasive grain may include an inorganic carbonaceous compound, such as diamond. The coupling agent may include a functional group configured to interact with and that may bind to the surface of the diamond particles.

An exemplary coupling agent includes a silane treatment agent capable of polymerizing with a reactive monomer. An example silane treatment agent includes γ-methacryloxylpropyltrimethoxysilane or γ-glycidoxypropyltrimethoxy silane. Additional surface reagents used to modify the polarity or hydrophobicity of the abrasive grains include, for example, isooctyl trimethoxysilane, phenyl trimethoxysilane, n-octadecyltrimethoxy silane, 3-cyanopropyl trimethoxysilane, 3-aminopropyl trimethoxysilane, or any combination thereof.

A hydrophilic, non-reactive surface treatment agent includes 2-[2-(2-methoxy)ethoxy]ethoxy acetic acid (MEEAA), mono(polyethyleneglycol)succinate, mono (polyethyleneglycol)maleate, or a combination thereof. An example of a hydrophilic and reactive acid suitable for the surface treatment includes 2-hydroxymethyl-2-[(N-methacryloxyethyl)carbamoylmethyl]propionic acid (PAMA), mono(acryloxypolyethyleneglycol)succinate, mono(acryloxypolyethyleneglycol)maleate, or a combination thereof. Another suitable reactive acid includes 2,2-bis[(N-methacryloxyethyl)carbamoylmethyl]propionic acid (PDMA), acrylic acid, methacrylic acid, β carboxyethylacrylate, mono-2-(methacryloxy)ethyl succinate, or mono-2-(methacryloxy) ethyl maleate. A further acid mixture useful for surface treatment may include aliphatic carboxylic acids, such as, for example, oleic acid, stearic acid, or octanoic acid; aromatic nonreactive acids, such as methoxy phenyl acetic acid or 3,4,5 triethoxy benzoic acid, itaconic acid, toluene sulfonic acid, ethylene glycol methacrylate phosphate; the salts thereof, or blends thereof.

Depending upon the nature of the first liquid component, the second liquid component is immiscible with the first liquid component and may be hydrophobic or hydrophilic. For example, when the first liquid component is hydrophilic, the second liquid component may be hydrophobic. An exemplary hydrophobic second liquid component includes oil-based liquids, such as linear or branched alkanes, for example, hexane, octane, decane, dodecane, or a mixture thereof, long chain fatty acids; aromatic hydrocarbons, such as benzene, toluene, xylene, or a combination thereof, ethers, for example, diethyl ether; esters, for example, ethyl acetate; silicone oils; or a combination thereof. Further, the second liquid component may include an emulsifier or a stabilizer.

Alternatively, when the first liquid component is hydrophobic, the second liquid component may be an aqueous-based solution or may be an organic component, such as a polar organic component, that is immiscible with the first liquid component. For example, the second liquid component may be an aqueous solution, for example, a saline solution; a short chain alcohol, for example, ethanol, butanol, methanol, isopropanol, propanol, or a combination thereof, glycerol; or a mixture thereof Further, the second liquid component may include an emulsifier or a stabilizer.

In particular, the second liquid component may be selected based on dielectric constant. For example, when the first liquid component is hydrophilic, the second liquid component may have a dielectric constant less than 15 and when the first liquid component is hydrophobic, the second liquid component may have a dielectric constant greater than 15.

In addition, the second liquid component may include a thickening agent. Depending upon the nature of the first liquid component, the thickening agent may be a cellulous-base thickening agent, a protein-based thickening agent, an inorganic thickening agent, or a combination thereof.

In a particular embodiment, the abrasive articles are prepared by combining polymer precursors and abrasive grains to form the first liquid component. In addition, catalyst or initiator, crosslinking agents, coupling agents, emulsifiers, or stabilizing agents may be added to the first liquid component. The first liquid component is emulsified with a second liquid component that is immiscible with the first liquid component. The second liquid component may also include emulsifiers or stabilizers. The emulsion is treated to facilitate polymerization of the polymer precursors. For example, the polymer precursors may be cured through exposure to radiation or through thermal treatment. Upon curing, the second liquid component is removed. Typically, the resulting polymer matrix with dispersed abrasive grains has an open cell structure exhibiting a pore and throat configuration. For example, FIG. 1 includes an illustration of an open cell structure exhibiting a pore and throat configuration. In particular, the open cell structure includes interconnected pores. The pore and throat configuration is formed when the droplets of the second liquid component are located in close proximity. The polymer matrix forms throats in areas in which the second liquid component droplets are in close proximity.

In a particular example, the void volume of the abrasive article is in a range of 50 vol % to 98 vol %, such as at least about 50 vol %. For example, the void volume of the abrasive article may be at least about 60 vol %, such as at least about 65 vol %, at least about 70 vol %, or even as high as 75 vol % or higher. The void volume is generally not greater than 98 vol %, such as not greater than 96 vol %. The polymer matrix with the abrasive grains dispersed therein form not greater than 50% by volume of the abrasive article, such as not greater than 40%, not greater than 35%, not greater than 30% or even as little as 25% or less of the abrasive article.

Further, the abrasive article has a specific surface area of at least 2.0 $m^2/g$. For example, the abrasive article may have a specific surface area of at least 3.0 $m^2/g$, such as at least 3.5 $m^2/g$.

EXAMPLES

Example 1

A sample is prepared that has dispersed diamond abrasive particles within the polymer phase. The sample is prepared using an organic phase polymer and an aqueous internal phase in a ratio of 20:80 organic:aqueous. The organic phase is prepared by adding 5 ml of poly(ethylene glycol) dimethacrylate (PEGDMA) to 5 ml of styrene in a covet. Titania (<1 μm) wetted with oleic acid is added to the mixture in an amount of 0.3 g and diamond grains (1-2 μm) are added to the mixture in an amount of 0.5 g. The covet containing the mixture is placed in a glass beaker containing ice. The mixture is stirred for 15 minutes at a speed of 50 RPM.

The mixture from the covet is transferred to a three neck flask. An AIBN initiator is added to the three neck flask in an amount of 0.15 g. The mixture is stirred for 2 min at 500 RPM.

The aqueous phase is added drop wise to the three neck flask using a pipette. The aqueous phase is a solution prepared by adding 10 g $CaCl_2.2H_2O$ to 250 ml of $H_2O$. After the aqueous phase is added to the flask, the stir speed is increased to 600 RPM. The emulsion is poured into a plastic tube and is treated at 70° C. for 24 hours to polymerize the polymer components.

Example 2

A sample is prepared that has dispersed diamond abrasive within the polymer phase. The sample is prepared using an organic phase polymer and an aqueous internal phase in a ratio of 40:60 organic:aqueous. The aqueous phase is prepared by adding 20 g of $CaCl_2.2H_2O$ to 250 ml $H_2O$.

The organic phase is prepared by adding 4 ml Hypermer, 0.2 g of an AIBN initiator, and 8 ml styrene to a beaker and is stirred to form a first mixture. Eight (8) ml poly(ethylene glycol) dimethacrylates (PEGDMA) is added to a covet with 0.8 g diamond particulate (1-2 μm). The covet is placed in a glass beaker containing ice and is stirred for 15 min at 50 RPM to form a second mixture. The first mixture and the second mixture are added to a three neck flask and are stirred at 50 RPM. The aqueous phase is added drop wise to the three neck flask using a pipette. The stir speed is increased to 600 RPM.

The emulsion is poured into a plastic tube and the emulsion is treated for 24 hours at 70° C. to polymerize the polymer components.

Example 3

Samples are prepared similar to the method of Example 2 using the polymer components and particulate (<1 μm) specified in TABLE 1 in amounts to form the porosity specified in TABLE 1. The polymer components and particulate form an oil phase. The aqueous phase described in relation to Example 2 is used in proportion to yield the specified porosity.

TABLE 1

| Sample | Polymer | Particulate | Porosity |
|---|---|---|---|
| 1 | Polystyrene-co-poly(poly(ethylene | 1 wt % CNT | 60 |
| 2 | glycol)dimethacrylate (50/50) | 1.9 wt % CNT | 60 |
| 3 | | 1 wt % $SiO_2$ | 80 |
| 4 | | 10 wt % $SiO_2$ | 80 |
| 5 | Polystyrene-co-poly(poly(ethylene | | 60 |
| 6 | glycol)dimethacrylate-co-methacryloxypropyl trimethoxy silane | 30 wt % $SiO_2$ | 60 |
| 7 | Polystyrene-co-poly(poly(ethylene | | 60 |
| 8 | glycol)dimethacrylate | | 80 |
| 9 | (50/50) | 20 wt % $SiO_2$[a] | 60 |
| 10 | | 20 wt % $SiO_2$[a] | 80 |
| 11 | | 40 wt % $SiO_2$[a] | 60 |
| 12 | | 40 wt % $SiO_2$[a] | 80 |

[a]surface grafted with methacryloxypropyl trimethoxysilane (MPS)

Example 4

Samples, including those described above, are tested using the following method to determine wear resistance. In addition, two commercial products, denoted BXL6550 and BX623D, available from Saint-Gobain Corporation are tested. The samples are aggressively ground with a silicon carbide abrasive paper to evaluate material (weight) loss and linear loss.

The testing method includes placing a 1.25 in×1.25 in sample corresponding to Example 1, Example 2, or samples 1-12 of Example 3 in an aluminum sample holder. The sample holder is cleaned, double sided tape is placed over the surface of the sample holder. The sample is placed onto the double sided tape and pressed into the sample holder.

A 600 grit silicon carbide paper is placed onto a Struers Rotopol-31 rotating table. The aluminum sample holder is placed into a Struers Rotoforce-4 rotating head and adjusted to contact the paper. The head is rotated clockwise and the table is rotated counter-clockwise at a speed of 150 RPM. The sample is abraded for 10 seconds with a force of 5 N or 10 N.

To determine wear resistance, the weight loss of the sample is determined by weighing the sample before and after abrading. In addition, the reduction in thickness is measured before and after abrading.

Figure 2:
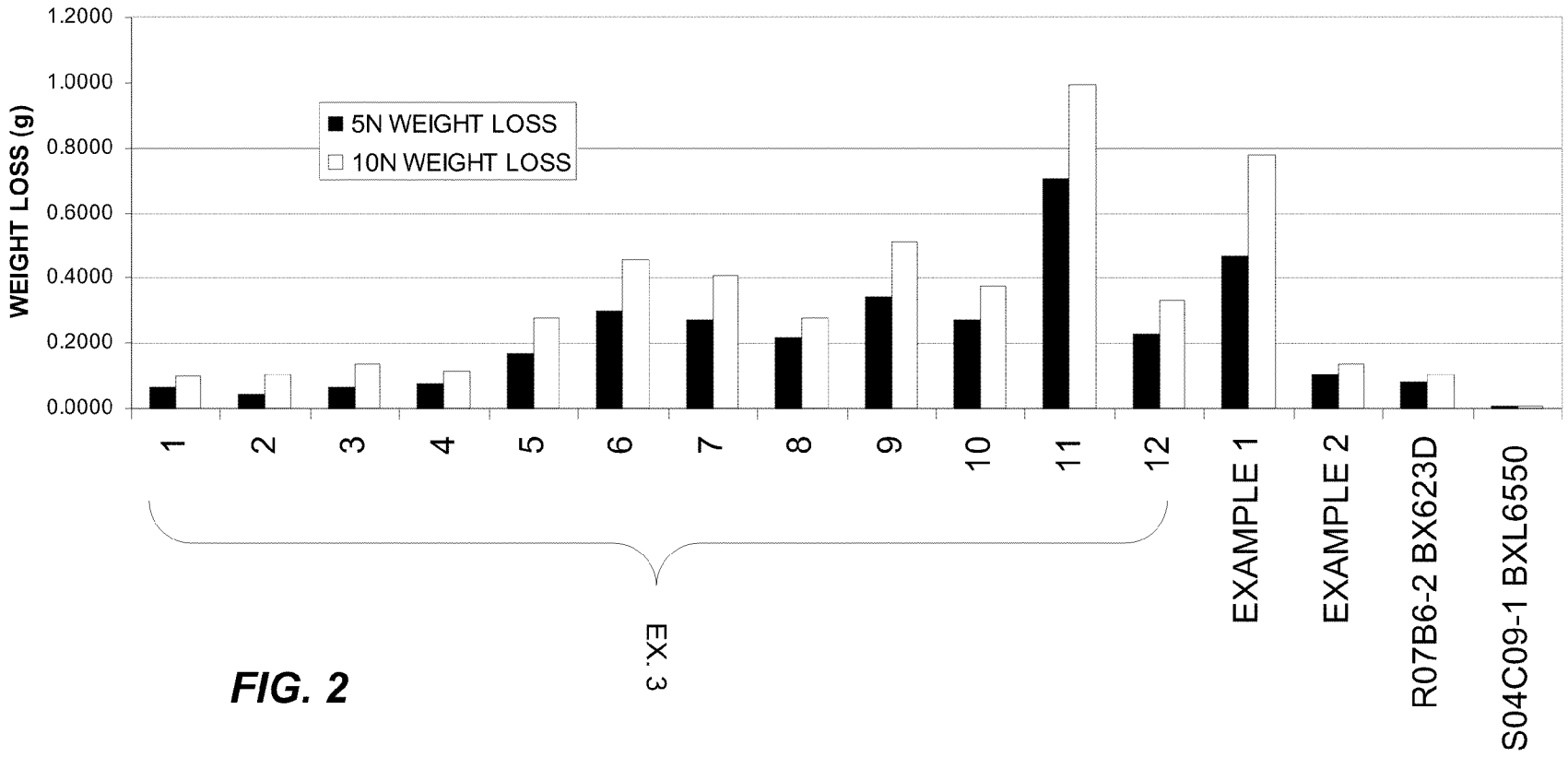
FIG. 2 and FIG. 3 include graphs illustrating the wear rate of samples.
Figure 3:
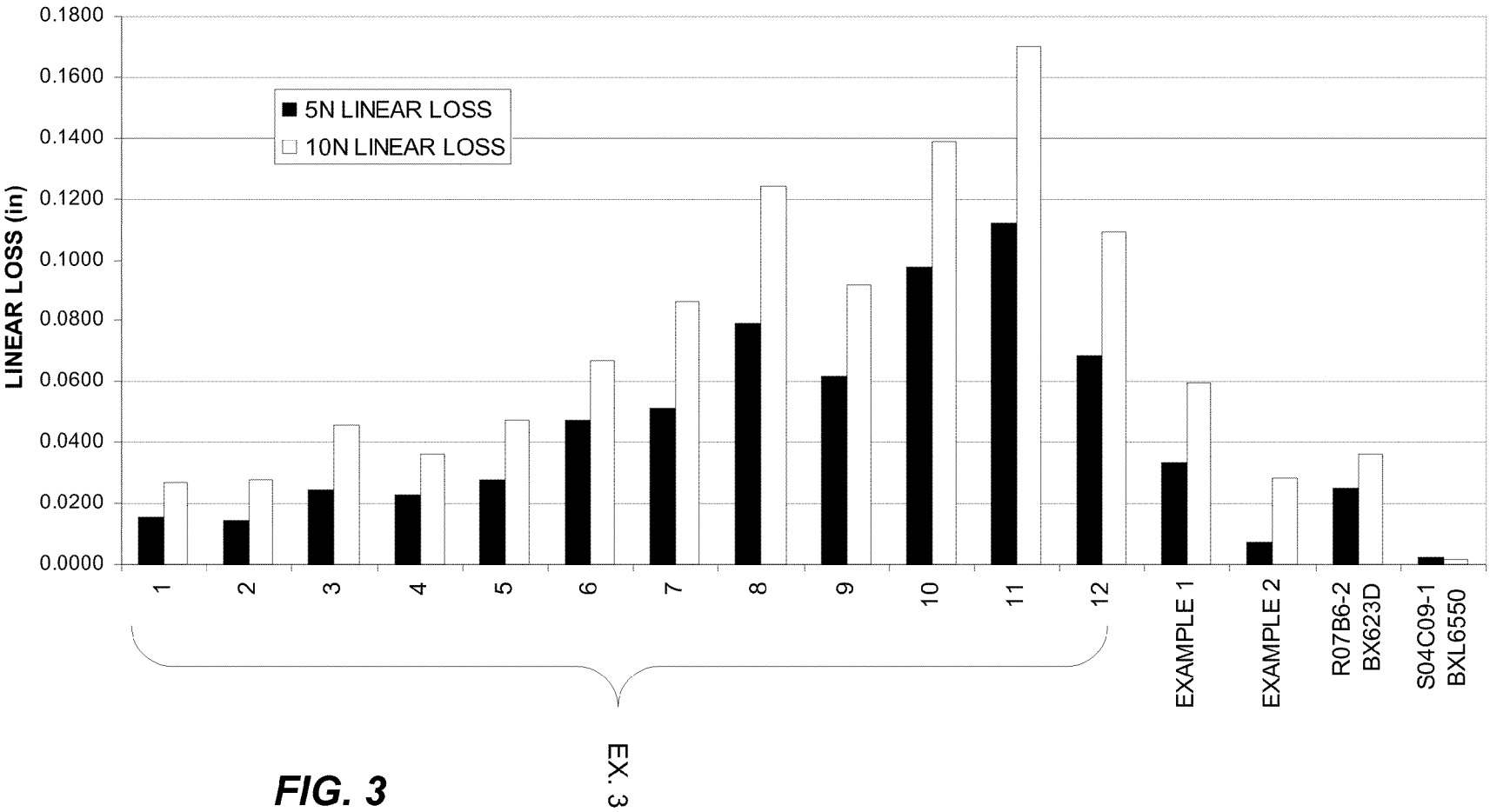

As illustrated in FIG. 2 and FIG. 3, the wear rate of the sample of Example 2 exhibits weight loss and linear loss on the same order as that of the BX623D product. Similarly, samples 1, 2, 3, and 4 of Example 3 exhibit comparable weight loss and linear loss.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciated that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article comprising:

a polymer matrix polymerized from a monomer having at least one double bond, wherein the polymer matrix has an open cell structure exhibiting a pore and throat configuration; and abrasive grains dispersed in the polymer matrix;

wherein the abrasive article has a void volume of at least 60%; and wherein the monomer is selected from the group consisting of vinyl, acrylate, methacrylate, conjugated diolefin, allene, and olefin halide monomers.

2. The abrasive article of claim 1, wherein the void volume is at least 65%.

3. The abrasive article of claim 1, wherein the abrasive grains have an average particle size of 0.1 μm to 100 μm.

4. The abrasive article of claim 1, wherein the abrasive grains are selected from the group consisting of silica, alumina, zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, and emery.

5. The abrasive article of claim 1, wherein the abrasive grains have a Mohs hardness of at least 8.

6. The abrasive article of claim 1, wherein the abrasive article includes greater than 10 wt % of the abrasive grains.

7. The abrasive article of claim 1, wherein the abrasive article includes 2 vol % to 30 vol % of the abrasive grains.

8. The abrasive article of claim 1, wherein the abrasive article has a surface area of at least 2.0 $m^2/g$.

* * * * *